United States Patent [19]

McClean

[11] 4,364,525

[45] Dec. 21, 1982

[54] BLADE ATTACHMENT FOR FOOD PROCESSOR

[76] Inventor: John W. McClean, 5 Beverly Crescent, Lakemba, New South Wales, Australia

[21] Appl. No.: 157,065

[22] Filed: Jun. 6, 1980

[51] Int. Cl.[3] ..... B02C 23/00

[52] U.S. Cl. ..... 241/92; 241/239; 241/282.1

[58] Field of Search ..... 241/92, 292.1, 282.1, 241/282.2, 278 R, 273.2, 286, 239; 83/699

[56] References Cited

U.S. PATENT DOCUMENTS 3,630,248 12/1971 Hanson ..... 241/278

4,256,265 3/1981 Madan ..... 241/92

4,283,979 8/1981 Rakocy et al. ..... 241/92 X

*Primary Examiner*—Mark Rosenbaum

*Assistant Examiner*—Timothy V. Eley

*Attorney, Agent, or Firm*—Karl F. Ross

[57] ABSTRACT

A rotatable cutting blade assembly for a food processor having an annular flange intended to fit closely in a circular container of a food processor, the flange having in it an aperture above which a blade is mounted, a screw-threaded arrangement being provided whereby the axial distance between the blade and flange may be adjusted continuously within the adjustment range so that sliced portions of vegetable material of any desired thickness may be produced.

4 Claims, 4 Drawing Figures

BLADE ATTACHMENT FOR FOOD PROCESSOR

FIELD OF THE INVENTION

The present invention relates to a blade attachment for a food processor of the kind in which a blade is rotated in a container and food-stuffs, such as pieces of carrot, potato or other vegetable are inserted through a tubular passage in the cover of the container for slicing by means of a blade rotating within the container, the sliced portions of vegetable falling into the container below the cutting plane of the blade.

BACKGROUND OF THE INVENTION

With the majority of food processors a rotatable blade assembly is provided which is capable of slicing vegetables to a predetermined thickness. If thicker or thinner slices are required it is necessary to use a different blade assembly. Such different blade assemblies may or may not be available for different brands of food processor.

OBJECT OF THE INVENTION

The object of the present invention is to provide a blade assembly for a food processor which is capable of adjustment so as to cut vegetables to any desired thickness within a predetermined range of thicknesses and also to provide a simple and robust mechanism whereby the adjustment may be effected.

SUMMARY OF THE INVENTION

The present invention provides a rotatable cutting blade assembly for a food processor having a hollow stem adapted to be placed in driving connection with a drive shaft of a food processor, an annular flange mounted on and co-axially with said stem, the flange being adapted to fit closely in a circular container of a food processor and having an upper surface having in it an aperture through which sliced vegetable material may pass through the flange into the portion of the container therebelow, a blade rotatable with said flange lying in or above said aperture, the blade lying in a plane substantially parallel to the upper surface of said flange, screw means whereby the spacing between the blade and the upper surface of the flange may be adjusted whereby sliced portions of vegetable material may be produced of any desired thickness within the range of adjustment of the said screw means.

BRIEF DESCRIPTION OF THE DRAWING

In order that the nature of the invention may be better understood a preferred form thereof is hereinafter described by way of example with reference to the accompanying drawing in which.

SPECIFIC DESCRIPTION

Figure 1:
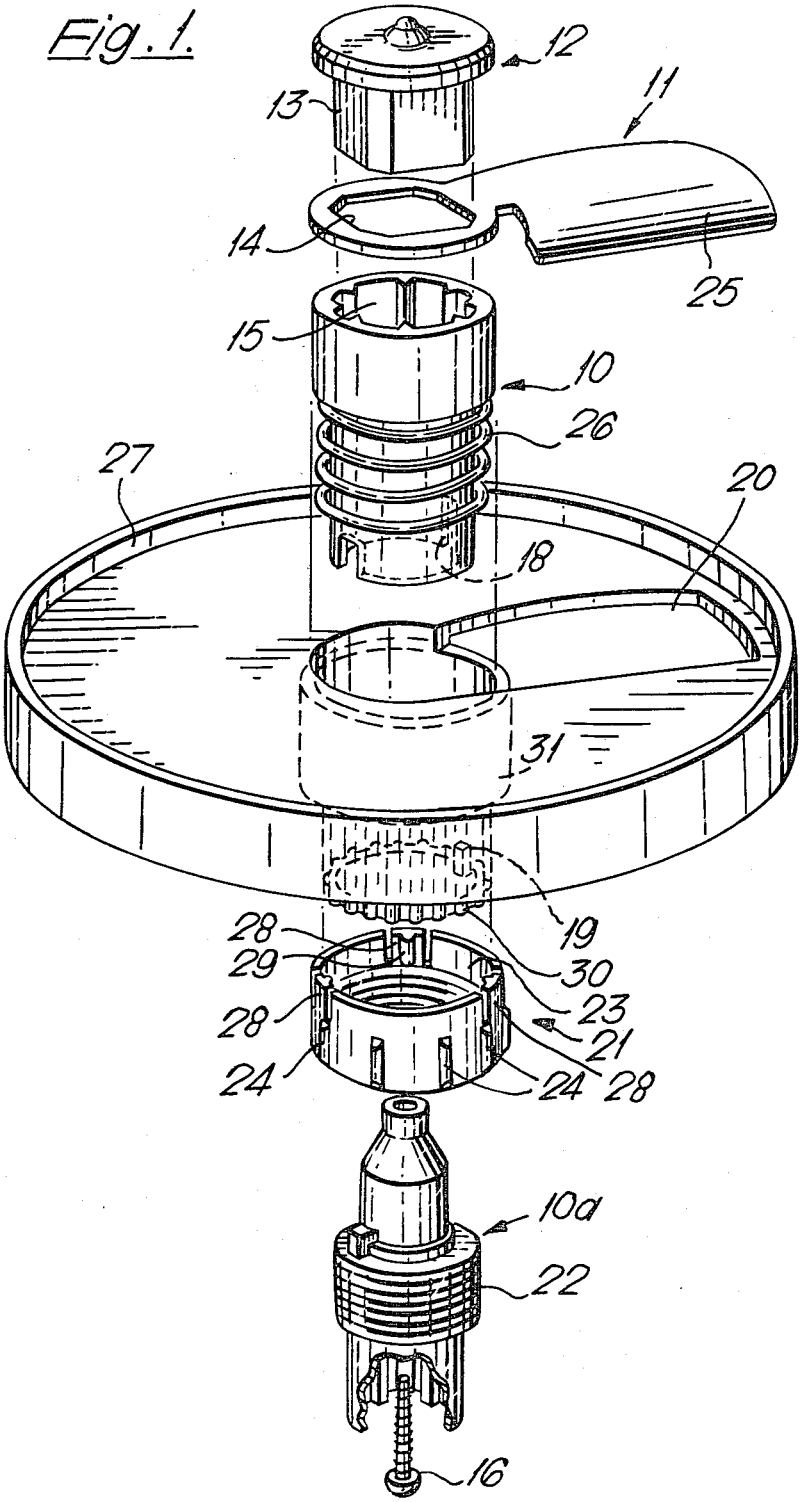
FIG. 1 is an exploded perspective view of a blade assembly according to the invention.
Figure 2:
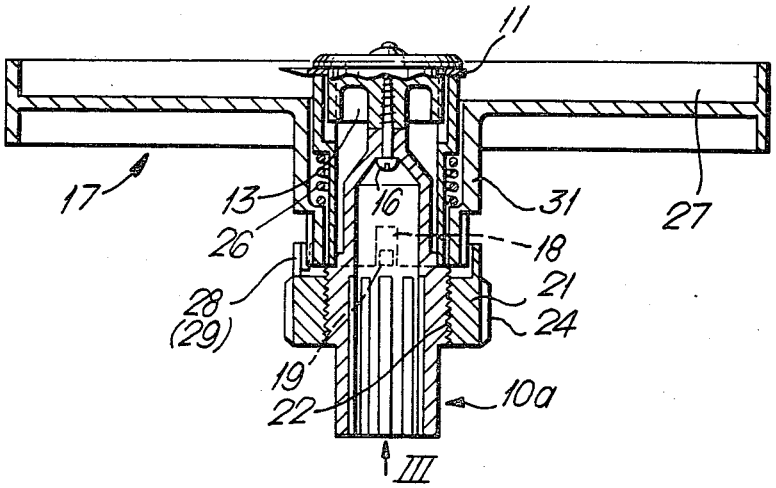
FIG. 2 is a median sectional view of the assembly shown in FIG. 1.
Figure 3:
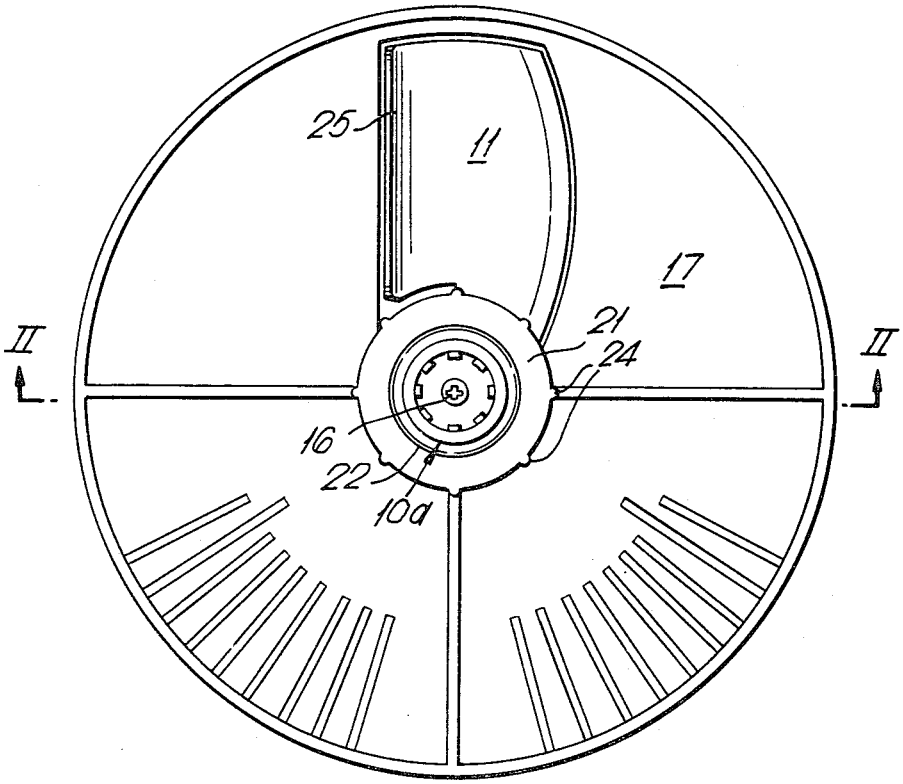
FIG. 3 is a plan view from below of the assembly shown in FIG. 2.

The assembly shown in the drawing consists of a tubular body 10 having fitted and keyed to its lower end an externally threaded sleeve 10*a* adapted to fit over the driving shaft of a food processor (not shown). To the upper end of the body 10 a stainless steel blade 11 is non-rotatably attached by means of a stud 12 having a square portion 13 which fits closely within the square aperture 14 in the blade 11 and a similar aperture 15 at the upper end of the body 10. These parts are held together by means of the screw 16. They can not rotate in relation to each other.

A circular flange 17 is slidably mounted on the body 10 so that it is free to move in an axial direction but is prevented from rotating with reference to the body by the co-operating keys 18 and keyways 19. A coil spring 26 acts to urge the body 10 and thus the blade 11 upwardly in relation to the flange 17. The flange 17 has a mainly flat upper surface and has in it an aperture 20 in which the blade 11 lies. The circumference of the flange 17 is such that it makes a close fit within a circular section container of a food processor (not shown). An annular wall 27 is provided around the periphery of the flange 17 and assists in controlling foodstuff fed to the blade 11.

An internally threaded ring 21 screws onto the male screw thread 22 formed on the body 10*a*. Ring 21 is provided around its periphery with ribs 24 by means of which it may be readily rotated manually. The ring 21 has an upwardly directed skirt 23 having in it three resilient tongues 28 each of which has an inwardly directed vertical rib 29. The three ribs 29 cooperate with corrugations 30 formed on the lower part of the boss 31 of the flange 17 to constitute resilient detent means such that the torque required to turn the ring 21 in relation to the boss 31 is sufficiently great to prevent turning when the device is in operation.

The flange 17 may be moved from a lower position in which the blade 11 projects to a maximum extent above the surface of the flange 17, to a position in which the blade lies substantially level with the upper surface of the flange 17 or slightly below it. Adjustment of the relative positions of the blade and the flange are effected by means of the ring 21 which is screwed in a clockwise direction to raise the flange 17 in relation to the blade 11 to decrease the space between the upper surface of the flange and the blade and thus reduce the thickness of sliced portions of vegetable cut and vice versa. It will be noted that the blade 11 has a trailing edge 25 which is directed downwardly at an angle. This serves todirect cut slices of vegetable material down into the part of the container of the food processor below the flange 17.

Indicia in the form of an index mark may be provided on the body 10 and graduations on the ring 21 to give an indication of the thickness of the slice cut at any adjusted position of the ring 21.

Figure 4:
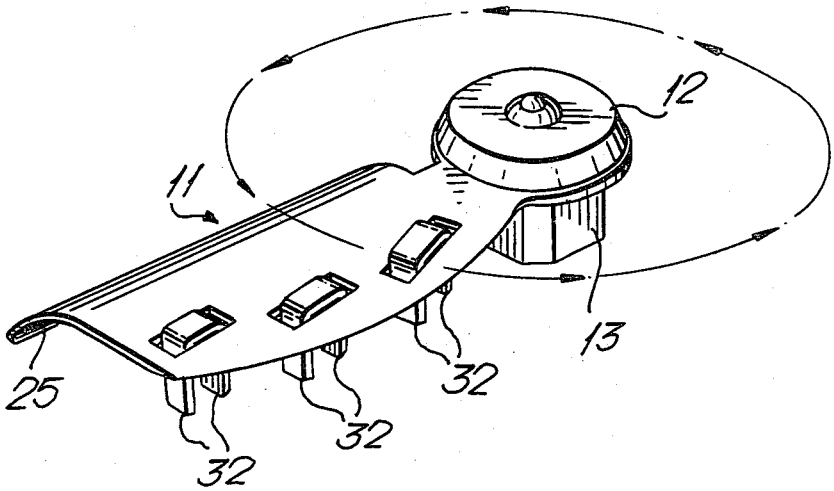
FIG. 4 is a perspective view of another embodiment of the blade assembly.

FIG. 4 shows an alternative form of construction of the blade 11 in which the blade is provided with a plurality of downwardly extending blade-like cutting members 32 extending downwardly from the under surface of the blade for a depth equal to the maximum thickness of slice that the machine is intended to produce, the blade-like members having cutting edges at their forward ends and being spaced apart a distance of the order of 5/16th of an inch. With this arrangement if, for example, a potato is inserted in the machine instead of being cut in slices it will be cut into "chips" suitable for frying.

The embodiment of the invention described above is given by way of example only as constituting one form of the invention as defined broadly above.

I claim:

1. A cutting blade assembly for a food processor comprising:

a tubular body;

a blade nonrotatably and axially fixed to said tubular body;

an annular flange keyed to but axially shiftable relative to said body and adapted to fit closely within a food processor container;

a spring seated against said body and said flange for urging said flange and said blade away from one another, said flange having an opening through which comminuted foodstuffs can pass to a portion of said container below said flange, said flange further being formed with a tubular boss;

a threaded ring engaging said boss and supporting said flange against the force of said spring;

a threaded sleeve engaging said ring connected to said body, said sleeve being provided with formations for mounting said assembly on a drive shaft of the food processor; and detent means between said ring and said boss for enabling forced rotation of said ring relative to said boss and said sleeve, thereby permitting adjustment of the relative axial positions of said blade and said flange to permit continuous adjustment of the thickness of slices produced by said assembly but preventing relative rotation of said ring and said sleeve during rotation of said assembly in food comminuting operation of said assembly.

2. The assembly defined in claim 1 wherein said sleeve is externally threaded and said ring is externally threaded to threadedly engage said sleeve.

3. The assembly defined in claim 1 or claim 2 wherein said detent means includes a plurality of resiliently deflectable inwardly projecting ribs on said ring and a multiplicity of outwardly projecting ribs on said boss engageable with said ribs on said ring.

4. The assembly defined in claim 1 or claim 2 wherein said blade is formed with downwardly projecting spaced-apart cutting members.

* * * * *

UNITED STATES PATENT AND TRADEMARK OFFICE

CERTIFICATE OF CORRECTION

PATENT NO. : 4 364 525

DATED : 21 December 1982

INVENTOR(S) : John W. McClean

It is certified that error appears in the above-identified patent and that said Letters Patent are hereby corrected as shown below:

In claim 2, line 2 (column 4, line 11), "externally" (second occurrence) should read -- internally --.

Signed and Sealed this

*Twelfth* Day of *March 1985*

[SEAL]

*Attest:*

DONALD J. QUIGG

*Attesting Officer* *Acting Commissioner of Patents and Trademarks*